United States Patent [19]

Tanaka

[11] Patent Number: 4,979,372

[45] Date of Patent: Dec. 25, 1990

[54] REFRIGERATION SYSTEM AND A THERMOSTATIC EXPANSION VALVE BEST SUITED FOR THE SAME

[75] Inventor: Hazime Tanaka, Yokohama, Japan

[73] Assignee: Fuji Koki Mfg. Co. Ltd., Tokyo, Japan

[21] Appl. No.: 321,351

[22] Filed: Mar. 10, 1989

[30] Foreign Application Priority Data

Mar. 10, 1988 [JP] Japan ..... 63-55009

[51] Int. Cl.[5] ..... F25B 41/04

[52] U.S. Cl. ..... 62/225; 236/92 B

[58] Field of Search ..... 236/92 B, 99 R; 62/225

[56] References Cited

U.S. PATENT DOCUMENTS

| | | | |
|---|---|---|---|
| 866,886 | 9/1907 | Ricketts | 236/99 R X |
| 1,925,530 | 9/1933 | Gotthardt | 236/99 R |
| 2,116,802 | 5/1938 | Shivers | 236/92 B X |
| 2,577,903 | 12/1951 | McGrath | 62/225 |
| 2,938,384 | 5/1960 | Soreng et al. | 236/99 R |
| 4,428,718 | 1/1984 | Skinner | 417/222 |
| 4,819,443 | 4/1989 | Watanabe et al. | 62/225 |

FOREIGN PATENT DOCUMENTS 61-153875 9/1986 Japan .

*Primary Examiner*—William E. Tapolcai
*Attorney, Agent, or Firm*—Joseph Scafetta, Jr.

[57] ABSTRACT

In a control method for a refrigeration system having a compressor, a condenser, a thermostatic expansion valve, and an evaporator, the amount of a refrigerant flowing into the evaporator is increased at a temperature lower than a predetermined evaporating temperature by a thermostatic expansion valve which opens even if the evaporating temperature is lower than the predetermined level and a superheat signal is lower than 0. In a thermostatic expansion valve best suited for the above method, either a gas adsorbent and at least two working fluids, different in a temperature-induced change of the amount of adsorption to the gas adsorbent, or a first working fluid, whose saturated vapor pressure is lower than the superheated vapor pressure of the refrigerant at the outlet of the evaporator, and a second working fluid incapable of being liquefied within the range of the evaporating temperature of the refrigerant, are sealed in the thermotube. The pressure of the working fluids in the thermo-tube becomes greater than a resultant force to be resisted, thereby moving a valve body to an open position, when the evaporating temperature of the refrigeration system is lower than a predetermined value and also when a difference between the superheated vapor temperature detected by the thermo-tube and the evaporating temperature of the refrigerant, that is a superheat, becomes lower than 0 degrees K.

5 Claims, 4 Drawing Sheets

REFRIGERATION SYSTEM AND A THERMOSTATIC EXPANSION VALVE BEST SUITED FOR THE SAME

BACKGROUND OF THE INVENTION

1. Field of the Invention

The present invention relates to a method for controlling a refrigeration system utilizing a thermostatic expansion valve, and the construction of the thermostatic expansion valve best suited for the method.

2. Description of the Related Art

In a refrigeration system, there is a thermostatic expansion valve which controls the flow rate of a refrigerant flowing into an evaporator, so as to keep constant the degree of superheat of the refrigerant, i.e., the difference between the evaporating temperature of the refrigerant in the evaporator and the temperature of superheated steam of the refrigerant in the evaporator after heat is exchanged with outside air. The expansion valve functions also as a refrigerant-pressure reducer.

The thermostatic expansion valve is opened to make the degree of superheat positive. In such a situation, the evaporator is used as a dry-type evaporator. This type will prevent the liquid from flowing back to a compressor.

Recently, new compressors which can vary their capacity in response to heat load were commercialized, but traditional ones which cannot fully control their capacity have been still widely used. In the traditional ones, the capacity thereof sometimes will rise to such an extent that there is a large excess over a value being necessary and sufficient to cause the refrigeration system to remove a heat load. This excess causes the evaporating pressure and evaporating temperature of the refrigerant in the evaporator to be lowered. In such a case, the outer surface of the evaporator is frosted and prevented from effecting satisfactory heat exchange, so that the refrigeration capacity of the refrigeration system is considerably reduced.

Such a situation often happens to those air conditioners which are carried by compact passenger cars. In these compact cars, a compressor is driven by a rotary force transmitted from an engine through a clutch. Therefore, the capacity of the compressor increases during high-speed operation of the engine, without regard to the value of the heat load. Thus, the air conditioners obtain an unnecessarily large capacity, thereby causing the aforesaid unsatisfactory situation.

In U.S. Pat. No. 4,428,718, for example, there is disclosed a method for controlling the capacity of a compressor in order to eliminate the aforementioned unfavorable situation. However, this conventional control method for the compressor capacity cannot be fully effective in comparison with its high cost performance. Conventionally, therefore, various other methods to solve this problem have been proposed, in which various other elements of the refrigeration system are controlled without controlling the compressor capacity.

In one particularly simple method, among these conventional methods, a part of the refrigerant flowing toward the evaporator, under the flow-rate control of the thermostatic expansion valve, is returned to the compressor through a by-pass circuit, without passing through the evaporator.

In the by-pass circuit disclosed in Japanese Utility Model Disclosure No. 61-153875, a constant-pressure expansion valve is mounted on the by-pass circuit. The constant-pressure expansion valve opens without regard to a control signal for the thermostatic expansion valve when the evaporating pressure of the refrigerant in the evaporator is reduced to a predetermined level or below.

The thermostatic expansion valve and the constant-pressure expansion valve described in the above Japanese document are combined to make one unit, as shown in FIG. 1. The unit includes a first drive section I, which is controlled by temperature and functions as the thermostatic expansion valve, and a second drive section II, which is controlled by pressure and functions as the constant-pressure expansion valve. Section I is constructed of a thermo-tube 10, a working fluid circulation pipe (capillary tube) 12, an operating chamber 14, and a first diaphragm 16, while section II is constructed of a constant-pressure chamber 18 and a second diaphragm 20. In this arrangement, when the capacity of a compressor rises so that the evaporating pressure and the evaporating temperature of the refrigerant in an evaporator are lowered, a refrigerant passage in the unit is used as a by-pass while the thermostatic expansion valve operates to close the passage. This combined unit, which has two functions as two kinds of valves, makes its whole appearance compact.

When the compressor operates in a predetermined range of its capacity so that the evaporating pressure and evaporating temperature of the refrigerant in the evaporator are relatively high, the pressure of a working fluid in the first drive section I becomes higher than that of a constant-pressure fluid in the constant-pressure chamber 18. The former pressure is transmitted to the upper surface of the second diaphragm 20 by a force-transmission member 22, which is interposed between first the and second diaphragms 16 and 20. The second diaphragm 20 causes a valve body 26 to move to its open position so that the transmitted pressure balances the sum of the urging force of a bias spring 24 and the pressure of the refrigerant from a condenser, applied to the lower surface of the second diaphragm 20. However, when the compressor begins to be operated over the predetermined range of its capacity so that the evaporating pressure and the evaporating temperature of the refrigerant in the evaporator drops, the pressure of the working fluid in the first drive section I becomes lower than the pressure of the constant-pressure fluid sealed in the constant-pressure chamber 18 of the second drive section II. Consequently, since the sum of the pressure of the working fluid in the first drive section I and the constant pressure in the second drive section II has been larger than the sum of the pressure of the refrigerant in the refrigerant passage of the unit and the biasing force of the bias spring 24, the valve body 26 moves toward its open position until the force applied on the lower surface of the second diaphragm 20 (the latter sum) balances the force applied on the upper surface of the second diaphragm 20 (the former sum).

FIG. 2 shows a gradually curved first line, which is schematically made by adding a biasing force of the bias spring 24 to the pressure-evaporating temperature chart of the refrigerant R-12 in the evaporator, and a lower partially bent, second line, which is schematically made by adding the constant pressure in the constant-pressure chamber 18 to the pressure-evaporating temperature chart of the working fluid in the first drive section I. As seen from FIG. 2, the valve opens without regard to the degree of superheat when the evaporating temperature of the refrigerant is lower than a predetermined level, in which the force applied to the upper surface of the second diaphragm 20 is larger than the force applied to the lower surface of the second diaphragm 20. Therefore, the capacity of the evaporator is reduced to such an extent that a part of the refrigerant remains in a liquid phase even at the outlet of the evaporator, so that the outer surface of the evaporator is prevented from becoming frosted. Liquid flowing back to the compressor is very harmful if the compressor is a reciprocating-type, because such liquid back flow may cause a valve in the compressor to be broken. In this case, however, such a liquid back flow is not harmful to the compressor, since the compact refrigeration system, using the combined constant-pressure/thermostatic expansion valve, usually uses a rotary-type compressor having a relatively low compression ratio.

Although the refrigeration system described above is theoretically effective, it has the following various structural problems.

A first problem is that the force transmission member 22 should be mounted between the first and the second diaphragms 16 and 20 of the first and the second drive sections I and II.

In order to transmit accurately a displacement of the first diaphragm 16 to the second diaphragm 20, the force transmission member 22 must smoothly slide on the inner peripheral surface of the constant-pressure chamber 18 of the second drive section II. Furthermore, in order to downwardly and uniformly press the upper surface of the second diaphragm 20, the force transmission member 22 must be shaped so that its contact surface on the second diaphragm 20 is wide enough, as shown in FIG. 1. For these reasons, the force transmission member 22, having a complicated configuration, must be worked with high accuracy.

A second problem is that the space in the constant-pressure chamber 18 of the second drive section II for the sealed fluid must be so large that a change of its volume due to a transformation of the first diaphragm 16 can be neglected. This necessity leads to two contradictory requirements, i.e. that the space for the working fluid in the first drive section I be minimized, and that the diameter of the first diaphragm 16 be maximized in order to produce a sufficiently great force by of a small amount of the working fluid.

A third problem is that the use of the two diaphragms 16 and 20 requires two welding processes in the manufacturing operation, thus entailing increased manufacturing costs, a higher possibility of malfunction, and a hindrance to compact designing.

SUMMARY OF THE INVENTION

The present invention has been contrived in consideration of these circumstances, and its object is to provide a control method for a refrigeration system, capable of fully controlling the capacity of a compressor, and a thermostatic expansion valve best suited for the method. A refrigerant in an amount more than necessary and for the removal of a heat load is fed into an evaporator without utilizing the functions of the prior art constant-pressure expansion valve, which has the aforementioned various drawbacks, in order to prevent the outer surface of the evaporator from becoming frosted. Thus, the capacity of the compressor rises over a predetermined range so that the evaporating pressure and evaporating temperature are lowered.

In order to achieve the above object, in the method according to this invention, a thermostatic expansion valve operates to supply an excessive amount of refrigerant to an evaporator so as to make a part of the refrigerant remain in a liquid phase at the outlet of the evaporator while the evaporating pressure and evaporating temperature are lowered by the rise of the capacity of the compressor, thereby preventing the outer surface of the evaporator from becoming frosted.

In one thermostatic expansion valve best suited for this novel and useful control method, an adsorbent, whose amount of adsorption changes depending on the temperature, and two or more working fluids different in the characteristic for adsorption to the adsorbent, are sealed in a thermo-tube.

In another thermostatic expansion valve best suited for the novel control method, a thermo-tube contains a first working fluid, whose saturated-vapor pressure is lower than a superheated-vapor pressure of a refrigerant in a refrigeration system when the temperatures of them are the same as each other. This thermo-tube also contains a second working fluid incapable of being liquefied within a working temperature range for the thermo-tube, and a temperature-sensitivity adjusting solid material adapted to retard an increase of the pressure inside the thermo-tube when the tube temperature rises, thus expediting the lowering of the pressure inside the tube when the tube temperature drops.

In the above described two kinds of thermostatic expansion valves best suited for the method of the present invention, since either the adsorbent and the two or more kinds of working fluids are contained in the thermo-tube, or the first working fluid with the aforementioned saturated vapor pressure characteristic, the uncondensable second working fluid, and the temperature-sensitive adjusting solid material are contained in the thermo-tube, the relationship between the pressure-evaporating temperature chart of the refrigerant in the refrigeration system and the pressure-temperature chart of the working fluids in the thermo-tube can be suitably selected.

The former thermostatic expansion valve, using the adsorbent, and the latter thermostatic expansion valve, using the uncondensable working fluid, both of which are suitable according to the invention, have the same fundamental functions.

While the compressor operates in a predetermined capacity range so that the evaporating pressure and the evaporating temperature of the refrigerant are in a predetermined range, the thermostatic expansion valve according to the present invention serves as an adsorption-charged thermostatic expansion valve to control the refrigeration system so that the degree of superheat of the system is always positive. This control is an ordinary function of a thermostatic expansion valve in the refrigeration system. If the compressor operates over the predetermined capacity range so that the evaporating pressure and the evaporating temperature of the refrigerant becomes lower than the predetermined range, the adsorption-charged thermostatic expansion valve cannot produce a force to move its valve body to the closed position. Accordingly, the valve controls the refrigeration system so that the system has a high negative degree of superheat, thus functioning in the same manner as a by-pass circuit. As a result, too much refrigerant to be gasified flows into the evaporator, and a part of the refrigerant remains in a liquid phase at the outlet of the evaporator. Thus, excessive refrigeration at the evaporator is prevented, so that the outer surface of the evaporator is prevented from becoming frosted. If the capacity of the compressor is lowered so that the evaporating pressure and the evaporating temperature rise into the predetermined range, the valve immediately functions as an ordinary thermostatic expansion valve to control the flow rate of the refrigerant so as to make the degree of superheat positive.

DETAILED DESCRIPTION OF THE PREFERRED EMBODIMENTS

Various embodiments of the present invention will now be described in detail with reference to the accompanying drawings of FIGS. 3 to 7.

Figure 2:
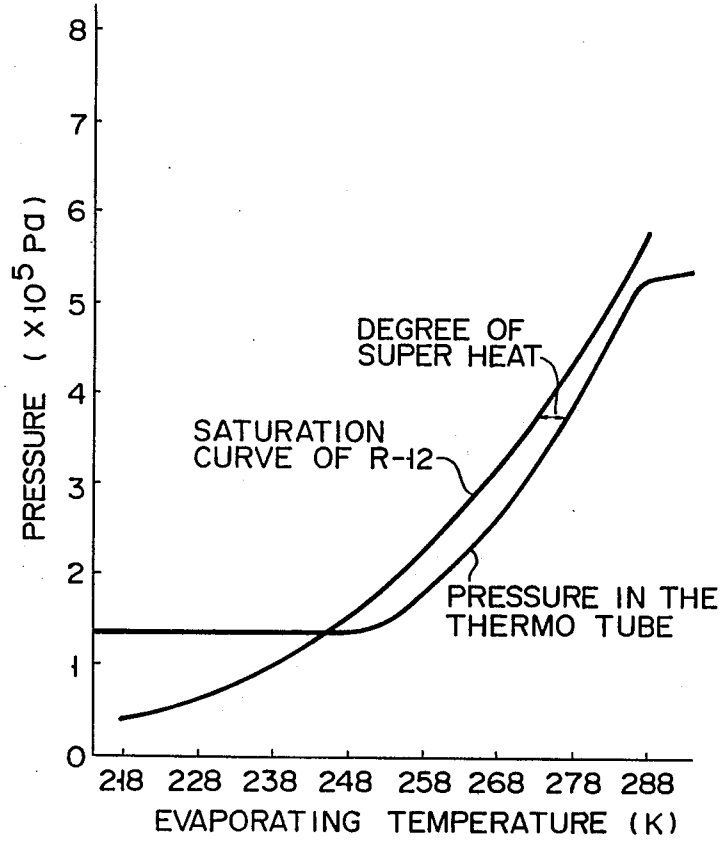
FIG. 2 PRIOR ART
FIG. 2 is a diagram schematically showing a chart, which is made by adding a constant pressure of a working fluid in a constant-pressure chamber to a temperature-pressure characteristic curve of a working fluid in a thermo-tube of the conventional expansion valve of FIG. 1, and a chart, which is made by adding a biasing force of a valve-body biasing spring to an evaporating temperature-saturated vapor pressure characteristic curve of a refrigerant at the outlet of the evaporator.
Figure 1:
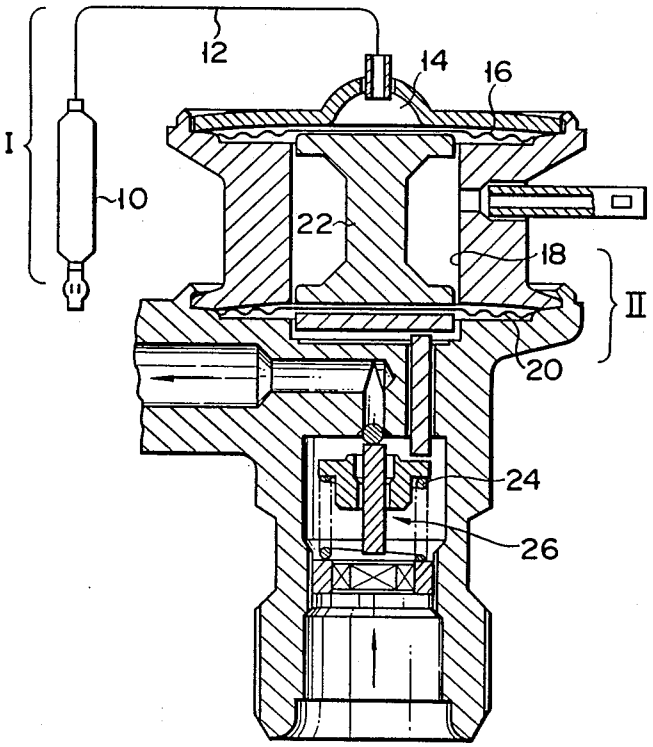
FIG. 1 PRIOR ART
FIG. 1 is a schematic longitudinal sectional view of a prior art constant-pressure/thermostatic expansion valve for preventing superrefrigeration in an evaporator.
Figure 3:
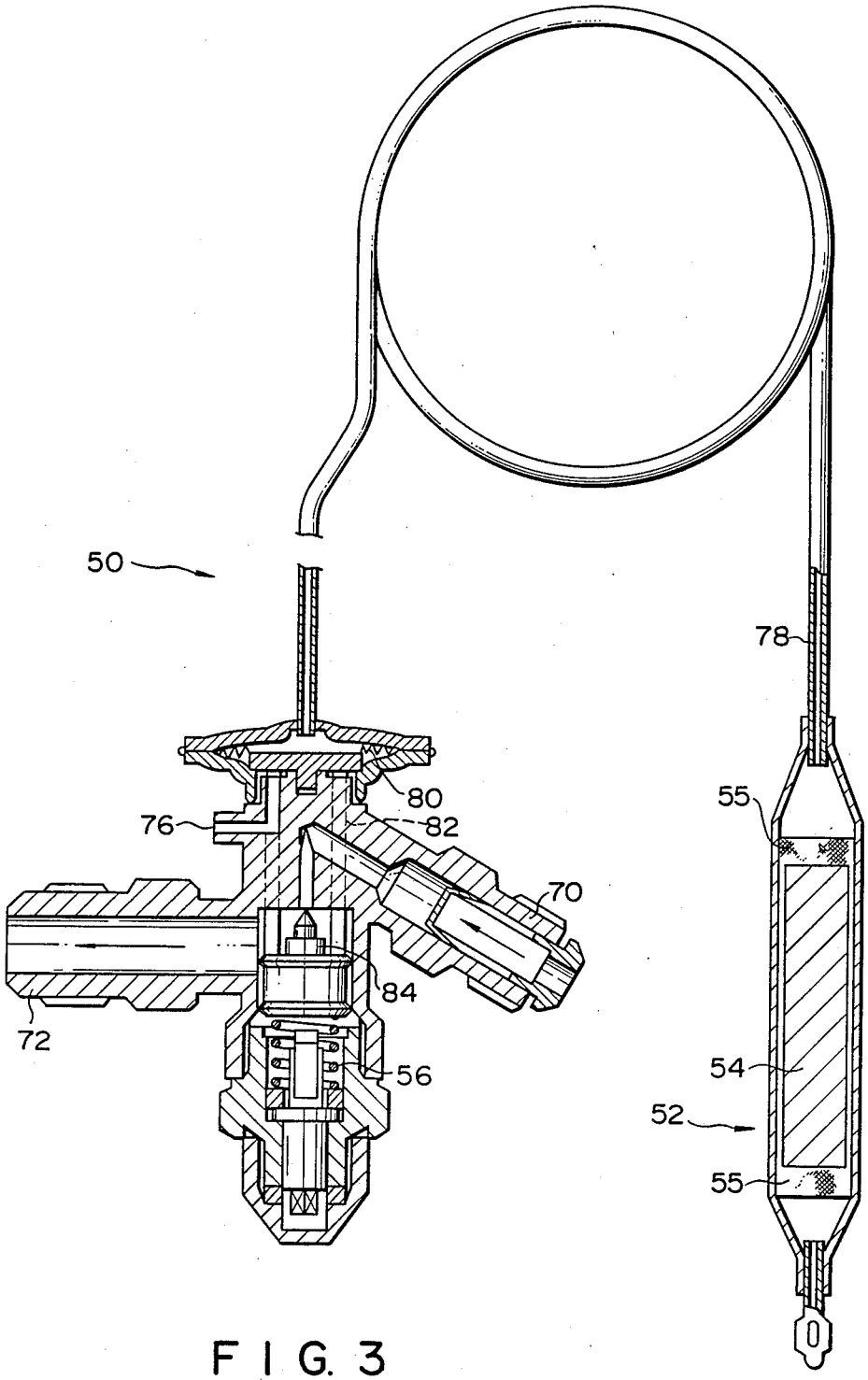
FIG. 3 is a schematic longitudinal sectional view of a thermostatic expansion valve according to a first embodiment of the present invention, used in place of the prior art constant-pressure/thermostatic expansion valve shown in FIG. 1.
Figure 4:
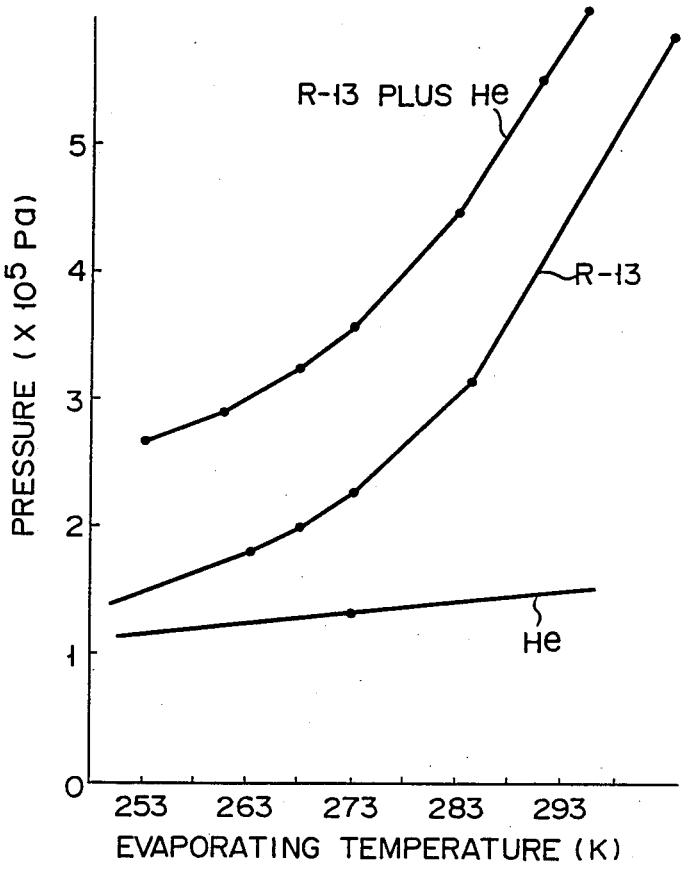
FIG. 4 is a diagram schematically showing an evaporating temperature-saturated vapor pressure characteristic curve of a working fluid (R-13) in a thermo-tube of the thermostatic expansion valve of FIG. 3 under the influence of a gas adsorbed by an adsorbent, a temperature-pressure characteristic curve of another working fluid (helium) in the thermo-tube under the same influence as described above, and a temperature-pressure characteristic curve which is made by adding up the characteristic values of the above two curves.

In a thermostatic expansion valve 50 according to a first embodiment of the present invention shown in FIG. 3, activated charcoal, for use as a gas adsorbent 54, is sealed in a thermo-tube 52 made of copper. Adsorbent 54 is fixed inside the thermo-tube 52 by a fixing member 55 in the form of a wire net. Further, R-13, for use as a first working fluid, and helium, for use as a second working fluid, are sealed in the thermo-tube 52. R-13 and helium have different adsorption factors with respect to the gas adsorbent 54. FIG. 4 shows characteristic curves representing the respective temperature-partial-pressure characteristics of R-13 and helium in the thermo-tube 52, in which the adsorbent 54 is sealed, and the sum of these characteristic values.

Figure 5:
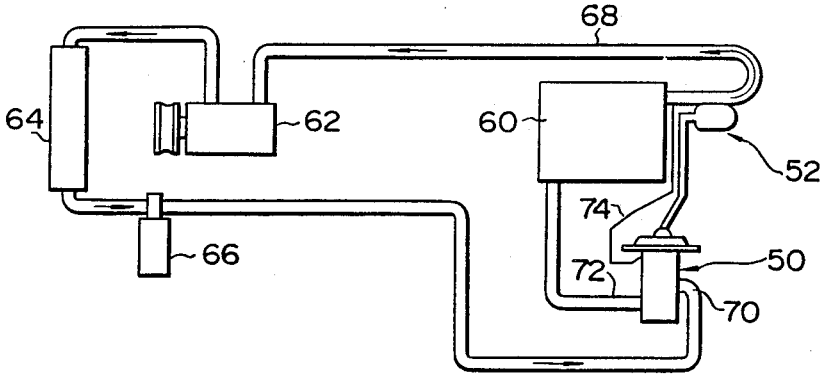
FIG. 5 is a schematic view showing an outline of a refrigeration system including the thermostatic expansion valve of FIG. 3.

FIG. 5 schematically shows an outline of the refrigeration system. In FIG. 5, there are shown an evaporator 60, a rotary compressor 62, a condenser 64, and a receiver tank 66, respectively.

As seen from FIG. 5 the thermo-tube 52 is disposed on a suction pipe 68, extending from evaporator 60 to the compressor 62, in the vicinity of the outlet of the evaporator 60, and is covered by a heat-insulating member. Inlet mouthpiece 70 and outlet mouthpiece 72 of the thermostatic expansion valve 50 are coupled to, respectively, a pipe extending from the receiver tank 66 and a pipe connected to the inlet of the evaporator 60.

Thermostatic expansion valve 50 further has a saturated-vapor-pressure inlet mouthpiece 76 (FIG. 3) coupled to a saturated-vapor-pressure detecting tube 74, through which a part of the saturated vapor of a refrigerant is taken out from the outlet of the evaporator 60. As shown in FIG. 3, an inside opening of the inlet mouthpiece 76 in the valve 50 faces an extended end of a capillary tube 78, which extends from the thermo-tube 52, with a diaphragm 80 being interposed therebetween. A lower surface of the diaphragm 80 which faces the inlet mouthpiece 76 is coupled to a valve body 84 by a coupling rod 82. The valve body 84 and the rod 82 serve to transmit the biasing force of a bias spring 56, which urges the valve body 84 toward a closed position, to the diaphragm 80.

Figure 6:
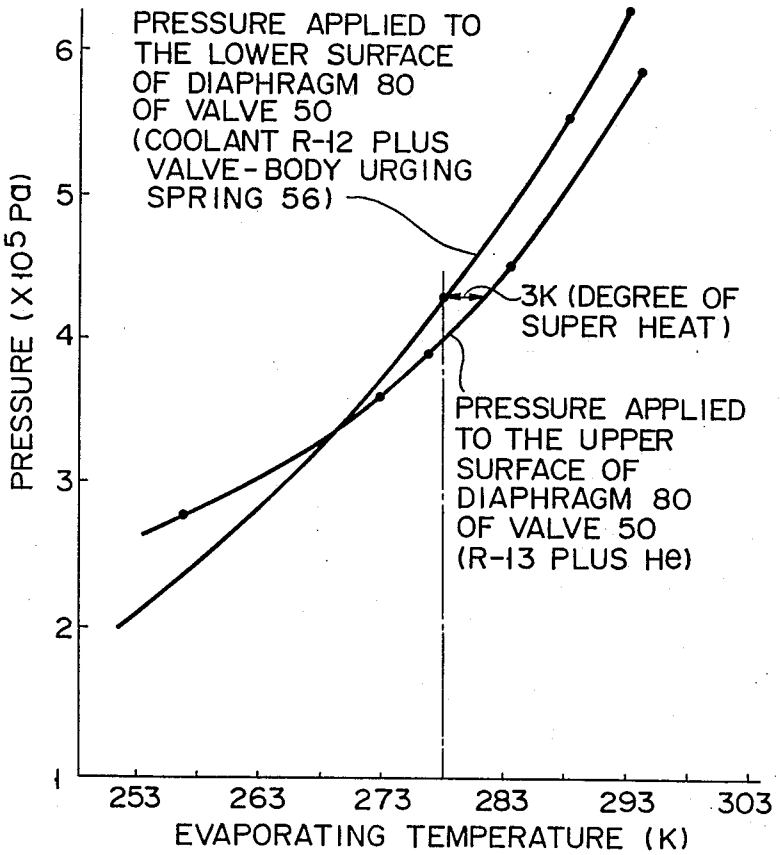
FIG. 6 is a diagram schematically showing changes in the pressure applied to the lower surface of a diaphragm of the thermostatic expansion valve of FIG. 3 (i.e., the sum of the biasing force of a valve-body bias spring and the pressure of a refrigerant at the outlet of the evaporator), and a pressure applied to the upper surface of the diaphragm (i.e., the sum of the pressures of the first and second working fluids (R-13 and helium) in the thermo-tube), with respect to the evaporating temperature.

FIG. 6 shows first and second temperature-pressure characteristic curves. The first curve is obtained by adding the biasing force of the bias spring 56 in the thermostatic expansion valve 50 to the pressure-evaporating temperature chart of the refrigerant at the outlet of the evaporator 60 in the refrigeration system using the valve 50. The second curve is obtained by the sum of the aforesaid characteristic values of R-13 and helium in the thermo-tube 52.

As seen from FIG. 3, the sum of the biasing force of the bias spring 56 and the saturated vapor pressure of the refrigerant, whose change with respect to the evaporating temperature is shown in FIG. 6, is applied to the lower surface of the diaphragm 80 of the expansion valve 50. As seen from FIG. 3, moreover, the equilibrium pressure of the first and second working fluids (R-13 and He) in the thermo-tube 52 under the influence of a gas adsorption by the adsorbent 54, whose change with respect to the evaporating temperature is shown in FIG. 6, is applied to the upper surface of the diaphragm 80.

Thus, the position of the valve body 84 in the expansion valve 50 depends on a difference $\Delta P$ between the forces applied to the upper and lower surfaces of the diaphragm 80.

As seen from FIG. 6, the magnitudes of the forces applied to the upper and lower surfaces of the diaphragm 80 are reversed in the vicinity of the evaporating temperature of 270 degrees K. In this embodiment, when the evaporating pressure of the refrigerant is larger than about $4\times10^5$ Pa and the evaporating temperature thereof is relatively high so that the degree of superheat to the saturated vapor pressure of the refrigerant at the outlet of the evaporator 60 attain +3 degrees K. or more, the force applied on the upper surface of the diaphragm 80 [i.e., the equilibrium pressure of the first and second working fluids (R-13+He) in the thermo-tube 52 under the influence of the gas adsorption by the adsorbent 54] is larger than the force applied on the lower surface of the diaphragm 80. Therefore, the valve body 84 is moved to the open position. When the degree of superheat becomes lower than +3 degrees K., the valve body 84 is moved toward its closed position. In this embodiment, the evaporating temperature obtained when the valve body 84 is surely moved to the closed position at the superheat 3 degrees K. is approximately 280 degrees K. When the evaporating temperature is approximately 270 degrees K., the magnitude of the forces applied to the upper and lower surfaces of the diaphragm 80 is reversed for each other. When the evaporating temperature is lower than approximately 270 degrees K., the valve body 84 is moved toward the open position under such condition that the superheat is lower than 0 degrees K.

Thus, in this embodiment, in contrast with the case of a conventional thermostatic expansion valve, the valve body 84 is surely moved to the open position at a low evaporating pressure to produce a low evaporating temperature less than approximately 270 degrees K., even if the superheat is 0 degrees K. Accordingly, the amount of the refrigerant flowing into evaporator 60 increases.

In this case, even if the driving force of the compressor 62 suddenly increases, all the refrigerant introduced into the evaporator 60 cannot fully evaporate, and a part of the refrigerant remains liquid. Accordingly, the refrigeration capacity of the evaporator 60 cannot substantially increase. Therefore, frosting of the outer surface of the evaporator 60 can be surely prevented. This frosting previously prevented the capacity of the evaporator 60 from being lowered when the refrigeration capacity of the refrigeration system was actually required.

Figure 7:
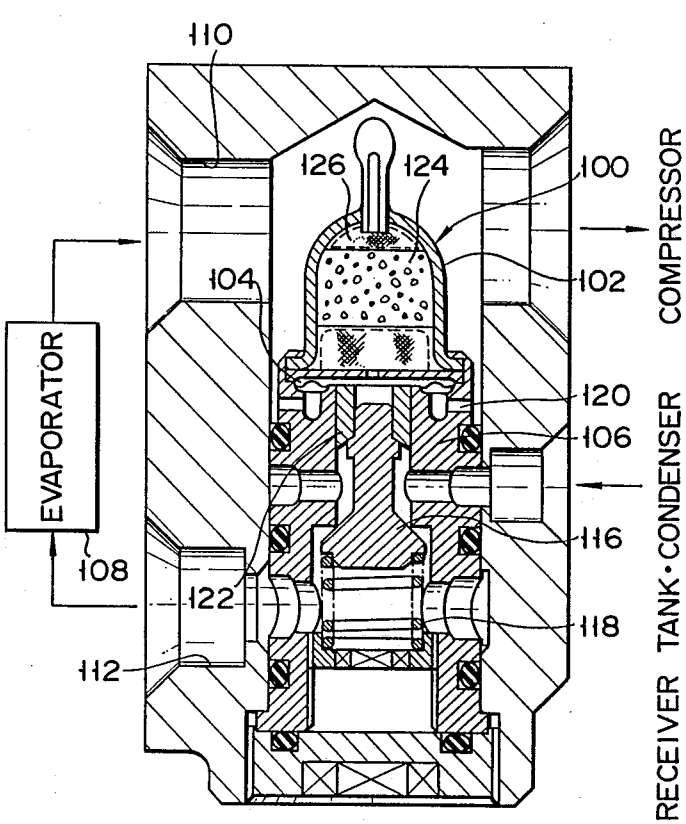
FIG. 7 is a schematic longitudinal sectional view of a thermostatic expansion valve according to a second embodiment of the present invention used in place of the prior art constant-pressure/thermostatic expansion valve shown in FIG. 1.

FIG. 7 shows a thermostatic expansion valve 100 made according to a second embodiment of the present invention. In this embodiment, a thermo-tube 102 is bell-shaped and is attached directly to a body housing 106 of the expansion valve 100 so that an opening of the tube adjoins a diaphragm 104 of the valve 100. As shown in FIG. 7, the valve 100 is located in a joint block which has a refrigerant discharge passage 110 and a refrigerant intake passage 112 connected to a refrigerant inlet and a refrigerant outlet, respectively, of an evaporator 108. Thermo-tube 102 projects into the discharge passage 110 and a valve mechanism section, including a valve body 116 and a valve-body urging spring 118, is situated in the intake passage 112. Saturated-vapor-pressure detecting hole 120 is formed in the body housing 106 so as to face the diaphragm 104 on the opposite side thereof to the opening of the thermo-tube 102. Saturated vapor of the refrigerant from the discharge passage 110 is guided through the detecting hole 120 to the opposite side of the diaphragm 104. Force transmission member 122 for transmitting the motion of the diaphragm 104 to the valve body 116 is interposed between the upper end of the valve body 116 and the lower surface of the diaphragm 104 (not facing the thermo-tube 102). In this embodiment, the material and the shape of the member 122 are specially selected so as not to transfer heat from the high-temperature saturated vapor of the refrigerant passing through the refrigerant discharge passage 110 to the low-temperature liquid refrigerant passing through the refrigerant intake passage 112.

In the present embodiment, moreover, freon C318 and helium gas are sealed in the thermo-tube 102. Freon C318 exhibits a lower saturated-vapor pressure than that of R-13 for use as a refrigerant in a refrigeration system using the expansion valve 100 when the temperature thereof is the same for each other. Helium gas never liquefies at the working temperature of the thermo-tube 102. Inside the thermo-tube 102, moreover, a temperature-sensitivity adjusting solid material 124 is fixed by a fixing member 126 in the form of a wire net. Solid material 124 is made of a ceramic which adsorbs neither freon C318 nor helium.

Adjusting solid material 124 makes the contact area of the gaseous freon C318 in contact with the inner surface of the thermo-tube 102 narrower than that of the liquid freon C318. This result occurs because the gaseous freon C318 can freely move the fine pores in solid material 124 made of ceramic while the liquid freon C318 cannot. Accordingly, the liquefying speed of the gaseous freon C318 is higher than the gasifying speed of the liquid freon C318. This difference indicates that the gradient of an increase of the pressure inside the thermo-tube 102 during a rise of the tube temperature is sharper than that of a reduction of the pressure during a temperature drop.

The correlation between a temperature-pressure characteristic curve, which is obtained by adding the pressure of helium to the saturated vapor pressure of freon C318 in the thermo-tube 102 according to the second embodiment, and a temperature-pressure characteristic curve, which is obtained by adding the urging force of the bias spring 118 to the saturated vapor pressure of the refrigerant in the refrigeration system of the second embodiment, resembles the correlation between the second characteristic curve, indicative of the sum of the characteristic values of R-13 and helium in the thermo-tube 52 according to the first embodiment shown in FIG. 6, and the first curve indicative of the sum of the characteristic values of the bias spring 56 and the refrigerant at the outlet of the evaporator 60.

Thus, the thermostatic expansion valve 100 of the second embodiment operates in the same manner as the thermostatic expansion valve 50 of the first embodiment. More specifically, the magnitude of the force applied to the upper surface of the diaphragm 104 of the expansion valve 100 and the magnitude of the force applied to the lower surface of the diaphragm 104 are reversed the each other at a predetermined evaporating temperature. Valve 100 operates as a conventional thermostatic expansion valve at a temperature higher than this predetermined evaporating temperature, and is open at a temperature lower than the predetermined temperature even if the superheat is lower than 0 degrees K.

Expansion valve 100 of the second embodiment, thus operating in the same manner as the expansion valve 50 of the first embodiment, has the same advantages of the valve 50.

The first and second working fluids (R-13 and helium) and adsorbent 54 in the thermo-tube 52 of the first embodiment may be replaced with the first and second working fluids (freon C318 and helium) and the temperature adjusting solid material 124 in the thermo-tube 102 of the second embodiment, and vice versa, without reducing or spoiling the advantages or departing from the spirit of the present invention.

What is claimed is:

1. A thermostatic expansion valve, comprising:

a thermo-tube means for containing a working fluid and for detecting a superheated vapor temperature of a refrigerant at an outlet of an evaporator in a refrigeration system, said working fluid changing its pressure in accordance with the detected superheated vapor temperatures;

a valve body being movable between an open position and a closed position and also being adapted to be driven, by means of the pressure of the working fluid contained in the thermo-tube means, towards the closed position;

means for urging the valve body towards said open position;

said working fluid in the thermo-tube means being constituted by a first working fluid having a saturated vapor pressure lower than a superheated vapor pressure of the refrigerant at the outlet of the evaporator, and also being constituted by a second working fluid incapable of being liquefied with a range of an evaporating temperature of the refrigerant;

said working fluid in the thermo-tube also driving the valve body so that a resultant force caused by a sum of the superheated vapor pressure of the refrigerant at the outlet of the evaporator and the force of the valve body urging means is resisted; and said pressure of said working fluid in the thermo-tube further becoming greater than the resultant force to be resisted, thereby moving the valve body to the open position when the evaporating temperature of the refrigerant is lowered under a predetermined level and a difference between the detected superheated vapor temperature and the evaporating temperature, that is a super heat of the refrigerant, is lowered under 0 degrees K.

2. The thermostatic expansion valve according to claim 1, wherein said thermo-tube means is coupled to a valve body housing so as to be adjacent to and integral with the valve housing.

3. The thermostatic expansion valve according to claim 1, wherein said thermo-tube means further contains a temperature sensitivity adjusting solid material made of a ceramic having a property which can either adsorb or absorb the working fluid contained in the thermo-tube means so as to adjust a temperature-sensitive speed of the thermo-tube means.

4. The thermostatic expansion valve according to claim 2, further comprising:

an integral joint block means for containing the thermostatic expansion valve, said block means having a refrigerant intake passage means and a refrigerant discharge passage means for communicating with a refrigerant inlet and a refrigerant outlet, respectively, of the evaporator;

said thermostatic expansion valve being housed in the integral joint block means in a manner such that the thermo-tube means and the valve body housing are exposed to the refrigerant discharge passage means and the refrigerant intake passage means, respectively.

5. A thermostatic expansion valve, comprising:

a thermo-tube means for containing a working fluid and for detecting a superheated vapor temperature of a refrigerant at an outlet of an evaporator in a refrigeration system, said fluid changing its pressure in accordance with the detected superheated vapor temperature;

a valve body being movable between an open position and a closed position and also being adapted to be driven, by means of the pressure of the working fluid contained in the thermo-tube means, toward the closed position;

means for urging the valve body towards said open position;

a valve body housing coupled to the thermo-tube means so as be adjacent thereto and integral therewith;

a temperature sensitivity adjusting solid material contained within the thermo-tube means, said material being made of a ceramic having a property which can either adsorb or absorb the working fluid contained in the thermo-tube means so as to adjust a temperature-sensitive speed of the thermo-tube means;

an integral joint block means for containing the thermostatic expansion valve, said block means having a refrigerant intake passage means and a refrigerant discharge passage means for communicating with a refrigerant inlet and a refrigerant outlet, respectively, of the evaporator;

said thermostatic expansion valve being housing in the integral joint block means in a manner such that the thermo-tube means and the valve body housing are exposed to the refrigerant discharge passage means and the refrigerant intake passage means, respectively;

said working fluid in the thermo-tube means being constituted by a first working fluid having a saturated vapor pressure lower than a superheated vapor pressure of the refrigerant at the outlet of the evaporator, and also being constituted by a second working fluid incapable of being liquefied within a range of an evaporating temperature of the refrigerant;

said working fluid in the thermo-tube means also driving the valve body so that a resultant force caused by a sum of the superheated vapor pressure of the refrigerant at the outlet of the evaporator and the force of the valve body urging means is resisted; and said pressure of the working fluid in the thermo-tube means further becoming greater than the resultant force to be resisted, thereby moving the valve body to the open position when the evaporating temperature of the refrigerant is lowered under a predetermined level and a difference between the detected superheated vapor temperature and the evaporating temperature, that is a super heat of the refrigerant, is lowered under zero degrees Kelvin.

* * * * *